United States Patent [19]

DeGregory

[11] 3,931,833

[45] Jan. 13, 1976

[54] FLUIDIC DEVICE

[75] Inventor: Donald Lee DeGregory, Reynoldsburg, Ohio

[73] Assignee: Bell Telephone Laboratories, Incorporated, Murray Hill, N.J.

[22] Filed: Oct. 2, 1974

[21] Appl. No.: 511,435

[52] U.S. Cl.... 137/829; 235/201 ME; 200/81.9 HG

[51] Int. Cl.[2] ..... F15C 3/06

[58] Field of Search..... 200/81.9 HG; 235/201 ME; 137/829

[56] References Cited

UNITED STATES PATENTS

| | | | |
|---|---|---|---|
| 3,450,340 | 6/1969 | Reader | 235/201 ME |
| 3,519,013 | 7/1970 | Amos | 235/201 ME |
| 3,548,857 | 12/1970 | Anderson | 235/201 ME X |
| 3,583,420 | 6/1971 | Campbell | 235/201 ME |

OTHER PUBLICATIONS

D. J. Truslove, Pneumatic Diode, IBM Tech. Disclosure Bulletin, Vol. 6 No. 3 August 1963, p. 30.

*Primary Examiner*—William R. Cline
*Attorney, Agent, or Firm*—Richard B. Havill

[57] ABSTRACT

A fluidic device comprising a housing having operate and release compartments separated by a passage is arranged with a pressure source for forcing a deformable moving element from either compartment into a deformation chamber connecting to the release compartment. The moving element is deformed to increase its potential energy by an amount which is sufficient to effect the element's movement from the deformation chamber to the operate compartment upon termination of the pressure.

6 Claims, 4 Drawing Figures

FLUIDIC DEVICE

BACKGROUND OF THE INVENTION

The invention is a fluidic device which is more particularly described as a fluid pressure operated switching device adapted to perform logical functions.

Fluidic devices are typically of two types — the so-called pure fluid devices having no moving elements, and devices having moving elements. Fluidic devices utilizing moving elements such as drops of mercury, pills and deformable rings are well known in the prior art and have been used as binary counters, on-off switches, and memory devices.

In one example of the prior art, shown in U.S. Pat. No. 3,583,420, issued to P. J. Campbell, a fluidic device includes two compartments connected by a passage and a globule of mercury disposed in one of the compartments. To move the globule from one compartment to the other, a pressure pulse is introduced via a pressure input path into the compartment to be vacated by the globule. Fluidic devices such as the one described above require pressure inputs to each compartment and are not capable of performing any logical functions without either coupling several of such devices into a large complex structure or intercoupling such devices with a fluidic device which has no moving elements and which requires an additional constant power source.

Therefore, it is an object of the invention to provide a simple, fluid pressure operated device.

Another object of the invention is to provide a simple, deformable moving element, fluid pressure operated device capable of performing various logical functions.

These and other objects of the invention are realized in an illustrative embodiment thereof in which a fluidic device consists of a housing having operate and release compartments separated by a passage. The operate compartment connects to a pressure source for forcing a deformable moving element from either compartment into a deformation chamber connected to the release compartment. The element is deformed to increase its potential energy by an amount which is sufficient to effect the element's movement from the deformation chamber to the operate compartment upon termination of the pressure.

A feature of the invention is a pressure means for forcing the deformable moving element into the deformation chamber to increase the element's energy by an amount which is sufficient to effect the element's movement from the deformation chamber to the operate compartment upon termination of the pressure.

Another feature of the invention is that the pressure means consists of only one input port and only one vent port.

Another feature of the invention is that a deformable moving element, fluid pressure operated device can perform plural logical functions.

BRIEF DESCRIPTION OF THE DRAWING

A better understanding of the invention may be derived from the detailed description following as that description is considered with respect to the attached drawings in which.

DETAILED DESCRIPTION

Fluidic devices may be constructed from any rigid, nonporous material including glass, ceramic, plastic and metal. Materials, used in the construction of fluidic devices having moving elements, have to be selected considering a design parameter which is not important in the design of devices without moving elements, that is the possibility of a moving element sticking to a material as for instance a globule of mercury has a tendency to stick to a plastic material.

Figure 1:
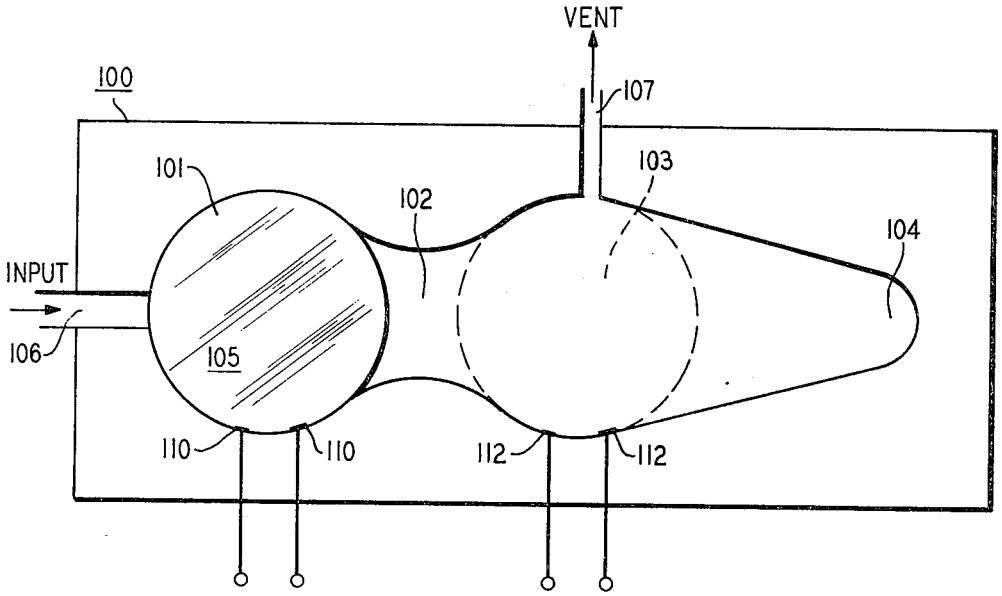
FIG. 1 shows an illustrative embodiment of a two-state fluid pressure operated switching device in accordance with the invention.
Figure 2:
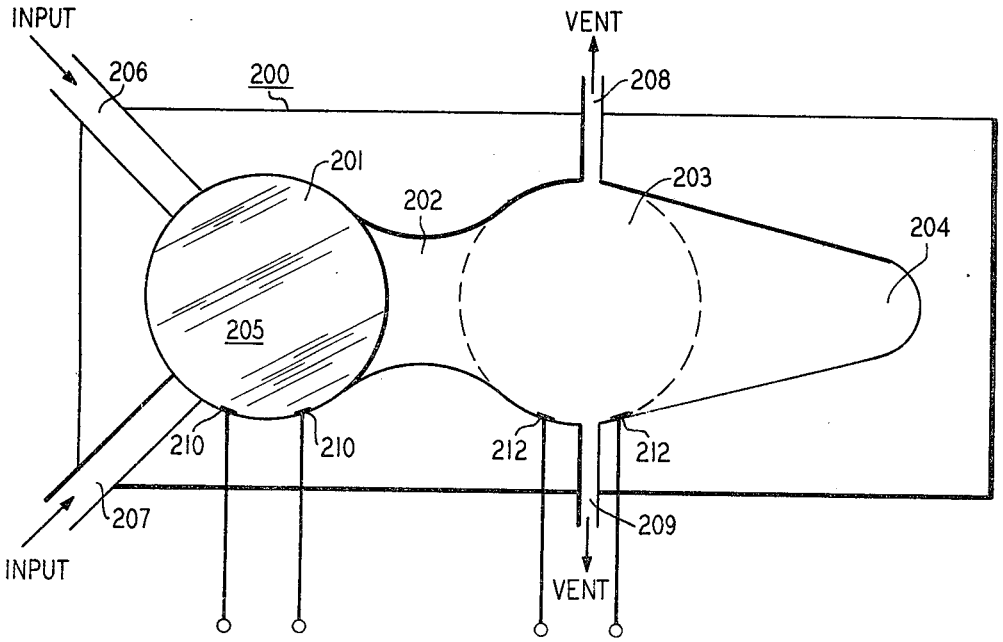
FIG. 2 shows an alternative embodiment of a two-state fluid pressure operated switching device in accordance with the invention.

Fluidic devices generally comprise a housing including a base and a cover. The base contains the required passages and compartments and the cover, when secured to the base, provides a fluid tight seal. For ease of illustration, the drawings of FIGS. 1 and 2 depict a device having a glass cover. This was done to permit the interior of the device to be shown without the confusing presence of cross section lines.

Referring now to FIG. 1 there is shown a two-state fluidic switching device which includes a housing 100, a cylindrical operate compartment 101, a cylindrical release compartment 103, and a passage 102 interconnecting the two compartments. A pressure port 106 connects to the operate compartment 101, and a vent port 107 and a tapered deformation chamber 104 connect to the release compartment 103. The operate compartment 101 contains a deformable moving element 105. The moving element 105, for the purpose of the detailed description, will be assumed to be made up of a globule of electrically conductive material such as mercury, the globule being of sufficient quantity and of sufficiently high surface tension to prevent free movement of the globule 105 through the passage 102. In the operate compartment 101, the globule 105 assumes a substantially cylindrical shape since it corresponds to the lowest potential energy level the globule can assume within the cylindrical operate compartment 101. The globule's potential energy at rest, $E_R$, can be expressed by the following $$E_R = \gamma\,(2A_{B101} + A_{S101}) \tag{1}$$

where $\gamma$ = surface tension of the liquid (lbs/in)

$A_{B101}$ = base area of the cylindrical operate compartment 101 ($in^2$)

$A_{S101}$ = side surface area of the cylindrical operate compartment 101 ($in^2$).

A fluid pressure source, not shown, supplies pressure to the device via the pressure port 106. Increasing the pressure in the operate compartment 101 forces the globule 105 to move into passage 102 toward the release compartment 103.

Figure 1A:
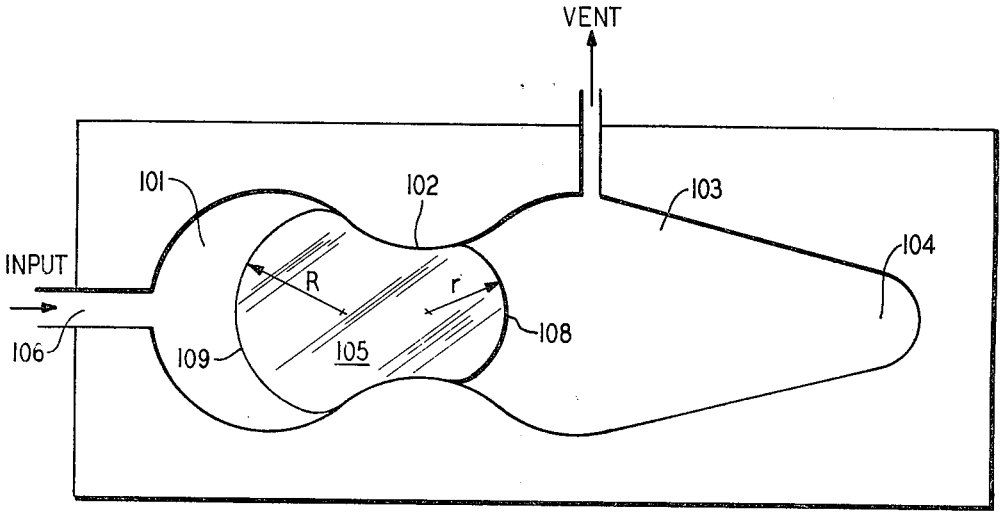
FIGS. 1A and 1B show a deformable moving element of the fluid pressure operated device depicted in FIG. 1 in various steps of deformation.

As shown in FIG. 1A, when the globule moves into the passage, the globule is deformed. In the deformed state a pressure differential is created within the globule. Surface tension of globule 105 produces a higher internal pressure within the globule at region 108, which has a relatively small radius "r," than the pressure at region 109, which has a relatively large radius "R." This pressure differential within the globule results in an internal force directed toward the operate compartment 101. Until more than half of the globule 105 passes through passage 102, this internal force counteracts a force developed by the fluid pressure which is pushing the globule 105 towards the release compartment 103.

Once more than half of the globule 105 is pushed through passage 102, the pressure differential within the globule 105 produces an internal force which continues to move the globule into the release compartment 103, aiding the pressure signal.

Energy $E_P$ required to move the first half of the globule 105 through the passage 102 can be calculated from the following:

$$E_P = P\,x\,\frac{\sqrt{101}}{2} \qquad (2)$$

where P = pressure applied to the input port 106 (lbs/in$^2$)

$V_{101}$ = volume of globule 105 (in$^3$).

In accordance with the invention, to return the globule 105 from the release compartment 103 to the operate compartment 101, a further fluid pressure signal is introduced into the release compartment 103 via the pressure port 106, operate compartment 101, and passage 102 to exert pressure upon the globule 105. For proper operation of the fluidic device the vent port 107 should be one-half or less than one half of the size of the input port 106, and the pressure signal should be of sufficient strength and duration to move the globule 105 into the deformation chamber 104.

Figure 1B:
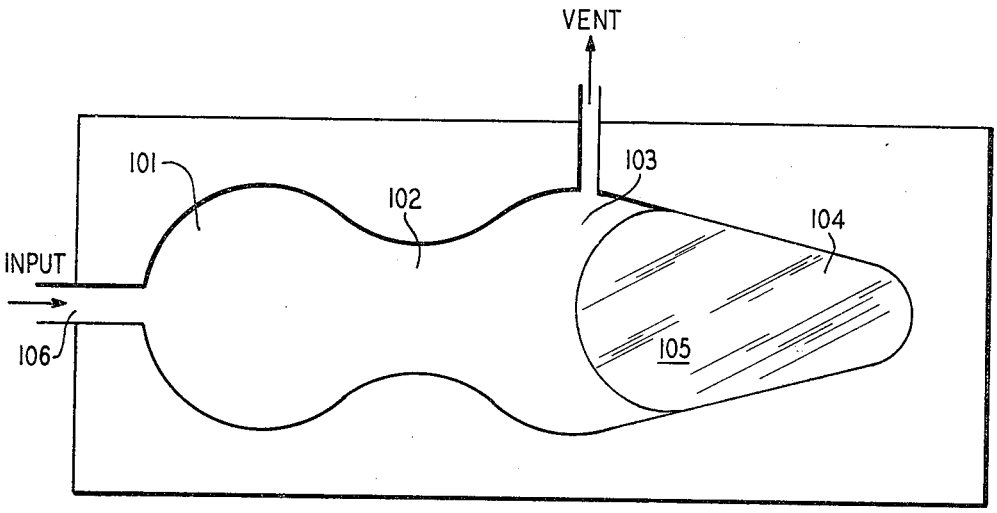

As shown in FIG. 1B, the pressure signal moves the globule 105 into the deformation chamber 104 forcing the globule to assume a shape substantially similar to the one shown. Although the deformation chamber 104 is large where connected to the release compartment 103, the opposite end of the deformation chamber is small and closed. By deforming the globule 105, the globule's potential energy is increased from its low energy state, $E_R$, by an amount which is sufficient to effect the movement of the globule 105 through passage 102 back to operate compartment 101, upon termination of the pressure signal.

The globule's potential energy in the deformed state:

$$E_D = \gamma\,(2A_{B104} + A_{S104}) \qquad (3)$$

where $A_{B104}$ = base area of the deformed globule 105 (in$^2$)

$A_{S104}$ = side surface area of the deformed globule 105 (in$^2$).

The amount of potential energy gained by the globule 105 by deformation is available to be converted to kinetic energy, $E_K$, which energy will effect movement of the globule 105 from its deformed state in the deformation chamber 104 back to its rest state in the operate compartment 101.

$$\begin{aligned} E_K &= [\text{energy of the globule } \mathbf{105} \text{ in the deformed state}] \qquad (4) \\ &-[\text{energy of the globule } \mathbf{105} \text{ at rest}] \\ &= E_D - E_R \\ &= \gamma\,[(2A_{B104} + A_{S104}) - (2A_{B101} + A_{S101})]. \end{aligned}$$

Since the volume of the globule is a constant and the height of each compartment and of the deformation chamber are equal, the base areas of the globule when at rest and when in the deformed state are also equal. Thus, the base areas can be dropped from Equation (4) resulting in the following expression:

$$E_K = \gamma\,(A_{S104} - A_{S101}). \qquad (5)$$

Neglecting energy losses caused by friction between the globule and walls of the compartments and the passage, the globule will possess sufficient energy to move itself through passage 102 into compartment 101 when the amount of energy gained by deformation is equal to or greater than the amount of energy required to move the globule 105 through passage 102 or:

$$E_K \geq E_P \qquad (6)$$

Substitution of expressions for $E_K$ and $E_P$ from Equations (2) and (5), respectively, into Equation (6) results in the following equation:

$$\Gamma\,(A_{S104} - A_{S101}) \geq P\,x\,\frac{\sqrt{101}}{2} \qquad (7)$$

Referring once again to FIG. 1 there is shown a sensing apparatus disposed in both compartments 101 and 103 providing an output signal indicating the position of globule 105. For example, since the globule 105 is of electrically conductive material, the sensing apparatus comprises a pair of electrical contacts 110 disposed in compartment 101 and a pair of electrical contacts 112 disposed in compartment 103. Each pair of contacts 110 and 112 is connected in a separate series circuit with its own indicator lamp across a power source. The lamp connected in series with the contacts 110 will light when the globule 105 bridges the contacts 110, and the lamp connected in series with the contacts 112 will light when the globule 105 bridges the contacts 112.

Referring now to FIG. 2 there is shown an alternative embodiment of the invention depicting a fluidic device within a housing 200, which device is particularly adapted to perform, in response to pressure signals, logical functions.

The fluidic device is substantially the same device as the one shown in FIG. 1 except that it has two pressure ports 206 and 207 connected to an operate compartment 201 and two vent ports 208 and 209 connected to a release compartment 203. For proper operation of the fluidic device, the overall size of the vent ports should be one-half or less than one-half of the overall size of the input ports.

Pressure inputs to ports 206 and 207 are adjusted so that a pressure signal appearing in either port 206 or 207 will cause a globule 205 to move from compartment 201 to the release compartment 203. If the globule 205 is already in compartment 203, the pressure signal from one of the ports will move the globule 205 towards a deformation chamber 204 until the vent ports 208 and 209 are exposed permitting venting of the pressure signal. Upon termination of the pressure signal the globule 205 moves itself back into the release compartment 203.

Pressure signals appearing simultaneously in both ports 206 and 207 will cause the globule 205 to move into the deformation chamber 204 whereby the globule gains sufficient potential energy to move itself to the operate compartment 201, upon termination of the pressure signals.

Thus, appearance of a single pressure signal in input port 206 or 207 always positions the globule in the release compartment 203. Simultaneous appearance of pressure signals in input ports 206 and 207 always positions the globule in the operate compartment 201.

Location of the globule 205 can be detected using contacts 210 and 212 and sensing apparatus similar to that described in the discussion of the arrangement shown in FIG. 1.

Although the embodiments of the drawing have depicted the operate and release chambers as comprising a substantially hourglass figure positioned in line with a deformation chamber which has a shape of a truncated cone, it will be apparent that other shapes may be employed with equal facility. Other types of moving elements may also be used. It is to be understood, therefore, that the above described arrangements are but illustrative of the application of the principles of the applicant's invention. Numerous other arrangements may be devised by those skilled in the art without departing from the spirit and scope of the invention.

What is claimed is:

1. A fluidic device comprising:

a housing having operate and release compartments separated by an interconnecting restrictive passage having a cross-sectional area smaller than the cross-sectional area of either compartment, the release compartment having a deformation chamber connecting thereto;

a deformable moving element disposed in the housing, the element having sufficient size with respect to the cross-section of the passage and sufficiently high surface tension to prevent free movement of the element through the passage; and pressure means connecting with the operate and release compartments for forcing the element into the deformation chamber and increasing potential energy of the element by an amount which is sufficient to effect the element's movement from the deformation chamber through the restrictive passage to the operate compartment upon termination of the pressure.

2. A fluidic device in accordance with claim 1 wherein said deformation chamber has a large end which is connected to the release compartment and a small end which is completely closed.

3. A fluidic device in accordance with claim 2 wherein the element can reside at rest in either compartment and wherein said pressure means includes only a pressure input port connected to the operate compartment and a vent port connected to the release compartment.

4. A fluidic device in accordance with claim 3 wherein the restrictive passage prevents free movement of the deformable element in either direction and where the amount of potential energy gained by the deformable moving element by deformation in the deformation chamber is equal to or greater than the amount of energy required to move the element through the passage.

5. A fluidic device in accordance with claim 2 where the deformation chamber is shaped so that the deformable moving element when forced into the chamber gains sufficient potential energy to move itself through the passage.

6. A fluidic logic device comprising:

a housing having operate and release compartments separated by an interconnecting restrictive passage having a cross-sectional area smaller than the cross-sectional area of either compartment, the release compartment having a deformation chamber connected thereto;

a globule of electrically conductive material disposed in the housing, the globule having sufficient size with respect to the cross-section of the passage and sufficiently high surface tension to prevent free movement of the globule through the passage;

electrically conductive contacts disposed in the operate and release compartments;

pressure means connecting to the compartments, the pressure means having first and second pressure input ports associated with the operate compartment and first and second vent ports associated with the release compartment;

where a single pressure pulse applied through a pressure input port moves the globule towards the deformation chamber until the vent ports in the release compartment are exposed permitting venting of the pressure signal and stopping further movement of the globule into the deformation chamber, which globule upon termination of the pressure pulse moves back into the release compartment bridging the contacts disposed in the release compartment; and where pressure pulses applied simultaneously to both pressure input ports force the globule into the deformation chamber increasing the globule's potential energy by an amount which upon termination of the pressure pulses is sufficient to effect the globule's movement through the restrictive passage to the operate compartment where the globule bridges the contacts disposed in the operate compartment.

* * * * *